US009051675B2

(12) United States Patent
Hong et al.

(10) Patent No.: US 9,051,675 B2
(45) Date of Patent: Jun. 9, 2015

(54) WASHING MACHINE

(75) Inventors: Sang Wook Hong, Seoul (KR); Ji Hee Kim, Seoul (KR); Sang Su Lee, Seoul (KR); Sun Young Park, Seoul (KR); Bon Kwon Koo, Seoul (KR); Jae Won Chang, Seoul (KR); Ki Young Kang, Seoul (KR); Chang Kwon Park, Seoul (KR)

(73) Assignee: LG Electronics Inc., Seoul (KR)

( * ) Notice: Subject to any disclaimer, the term of this patent is extended or adjusted under 35 U.S.C. 154(b) by 867 days.

(21) Appl. No.: 13/260,182

(22) PCT Filed: Sep. 11, 2009

(86) PCT No.: PCT/KR2009/005176

§ 371 (c)(1),
(2), (4) Date: Sep. 23, 2011

(87) PCT Pub. No.: WO2010/128725

PCT Pub. Date: Nov. 11, 2010

(65) Prior Publication Data

US 2012/0137739 A1 Jun. 7, 2012

(30) Foreign Application Priority Data

May 4, 2009 (KR) ..... 10-2009-0039045

(51) Int. Cl.
*D06F 39/00* (2006.01)
*D06F 33/02* (2006.01)

(52) U.S. Cl.
CPC ..... *D06F 39/005* (2013.01); *D06F 33/02* (2013.01); *D06F 39/00* (2013.01)

(58) Field of Classification Search
CPC ..... D06F 39/005; D06F 39/00; D06F 33/02
USPC ..... 68/12.12, 12.16, 12.23, 12.26, 13 R, 140
See application file for complete search history.

(56) References Cited

U.S. PATENT DOCUMENTS

| | | | | |
|---|---|---|---|---|
| 5,241,845 | A * | 9/1993 | Ishibashi et al. | 68/12.02 |
| 8,016,444 | B2 * | 9/2011 | Cho et al. | 362/91 |
| 8,656,744 | B2 * | 2/2014 | Kim et al. | 68/12.01 |
| 2005/0223506 | A1 * | 10/2005 | Kwen et al. | 8/159 |
| 2007/0107140 | A1 * | 5/2007 | Choi et al. | 8/158 |

FOREIGN PATENT DOCUMENTS

| | | | |
|---|---|---|---|
| WO | WO2007021082 | A3 | 4/2007 |
| WO | WO2009004021 | A1 | 1/2009 |

OTHER PUBLICATIONS

International Search Report issued in International Application No. PCT/KR2009/005176 mailed May 23, 2011.

* cited by examiner

*Primary Examiner* — Joseph L Perrin
(74) *Attorney, Agent, or Firm* — Fish & Richardson P.C.

(57) ABSTRACT

A washing machine is disclosed. The washing machine has a function of rotating a drum (130) at a low speed when a user pulls out laundry, enabling the user to easily search through the laundry. The washing machine includes a cabinet (100) defining an exterior appearance of the washing machine, a tub (120) mounted in the cabinet (100) and configured to receive wash water therein, a drum (130) rotatably mounted in the tub (120) and configured to receive laundry therein, an independent drive input unit (200) to send a drum rotating signal, so as to allow a user to operate the drum (130) independently of a washing process, and a control unit to control rotation of the drum (130) in response to a signal received from the independent drive input unit (200).

18 Claims, 3 Drawing Sheets

WASHING MACHINE

CROSS REFERENCE TO RELATED APPLICATIONS

This application is a U.S. National Phase Application under 35 U.S.C. §371 of International Application PCT/KR2009/005176, filed on Sep. 11, 2009, which claims the benefit of Korean Application No. 10-2009-0039045, filed on May 4, 2009, the entire contents of which are hereby incorporated by reference in their entireties.

TECHNICAL FIELD

The present invention relates to a washing machine, and more particularly, to a washing machine having a function of rotating a drum at a low speed when a user pulls out laundry, enabling the user to easily search through the laundry.

BACKGROUND ART

Generally, a drum type washing machine broadly includes a cabinet defining an exterior appearance of the washing machine, a tub mounted in the cabinet and configured to receive wash water therein, and a drum rotatably mounted in the tub. The drum is provided at an inner peripheral surface thereof with a plurality of lifters. The lifters function to lift and drop laundry during rotation of the drum, allowing the laundry to be washed through tumbling. The washing machine performs, e.g., washing, rinsing, dehydrating, and drying operations.

Once a washing process (here, "washing process" includes a series of washing, rinsing, dehydrating, and drying operations, and is distinguished from the washing operation that is carried out to remove contaminants from laundry) is completed, a user pulls washed laundry out of the drum.

In this case, it may often be observed that the laundry tends to one side or clumps together. Large articles of laundry may be easily pulled out because they are easily distinguishable from each other. However, small articles of laundry, such as socks, may often become trapped between different kinds of laundries or be placed on the lifters. Therefore, to pull out the small articles of laundry, the user may inconveniently manually rotate the drum by grasping the lifters.

DISCLOSURE OF INVENTION

Technical Problem

An object of the present invention devised to solve the problem lies on a washing machine having a function of rotating a drum at a low speed when a user pulls out laundry, resulting in easy laundry search.

Technical Solution

The object of the present invention can be achieved by providing a washing machine including a cabinet defining an exterior appearance of the washing machine, a tub mounted in the cabinet and configured to receive wash water therein, a drum rotatably mounted in the tub and configured to receive laundry therein, an independent drive input unit to send a drum rotating signal, so as to allow a user to operate the drum independently of a washing process, and a control unit to control rotation of the drum in response to a signal received from the independent drive input unit.

The cabinet may include a control panel on which a plurality of function buttons is installed, and a door for input of the laundry.

The independent drive input unit may be provided on the cabinet.

The independent drive input unit may be provided at a portion of the cabinet that is exposed to the user when the door is opened.

The independent drive input unit may be positioned so as not to be pressed by the door when the door is closed.

The independent drive input unit may be provided on the control panel.

The drum may be controlled to be rotated at a preset revolutions per minute when the signal is received from the independent drive input unit.

The drum may be controlled to perform a single forward rotation when the signal is received from the independent drive input unit.

The drum may be controlled to sequentially perform a single forward rotation and a single reverse rotation when the signal is received from the independent drive input unit.

The drum may be controlled to be operated after the signal is continuously received from the independent drive input unit for a predetermined time or more.

The drum may be controlled to be operated only while the signal is being received from the independent drive input unit.

The control unit may maintain standby power even if a power source is switched off, to operate the drum when the signal is received from the independent drive input unit.

The control unit may apply power even if a power source is switched off, to operate the drum when the signal is received from the independent drive input unit.

The control panel may further include a child lock button to prevent operation thereof by a child.

The independent drive input unit may apply an operating signal after a locking state is released by operation of the child lock button.

A door gasket for water tightness may be installed between the door and the tub, and a lamp may be installed on the door gasket to irradiate light toward the interior of the drum.

Advantageous Effects

As described above, in a washing machine according to an embodiment of the present invention, a drum is rotated at a low speed when a user pushes a laundry search button. This allows the user to easily pull out laundry without manually rotating the drum, resulting in enhanced user convenience.

BRIEF DESCRIPTION OF DRAWINGS

The accompanying drawings, which are included to provide a further understanding of the invention, illustrate embodiments of the invention and together with the description serve to explain the principle of the invention.

In the drawings.

BEST MODE FOR CARRYING OUT THE INVENTION

Reference will now be made in detail to the preferred embodiments of the present invention, examples of which are illustrated in the accompanying drawings.

Hereinafter, a washing machine according to an embodiment of the present invention will be described in detail with reference to the accompanying drawings.

Figure 1:
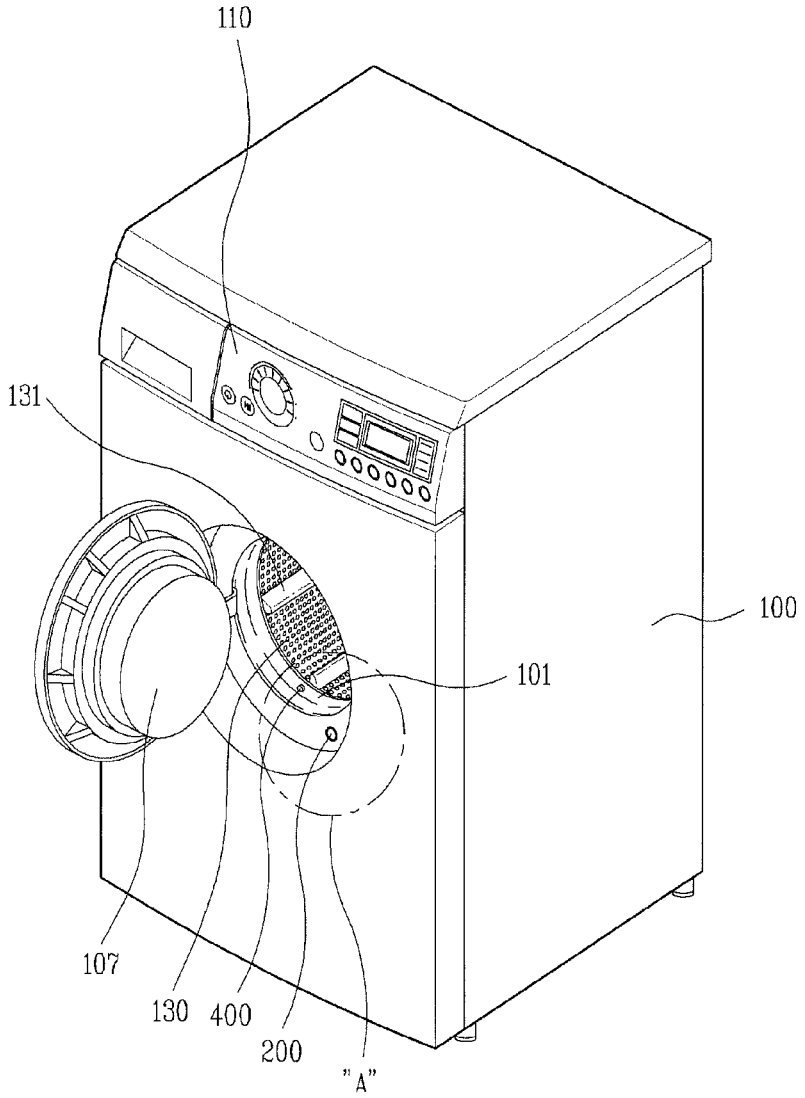
FIG. 1 is a perspective view of a washing machine according to an embodiment of the present invention.
Figure 2:
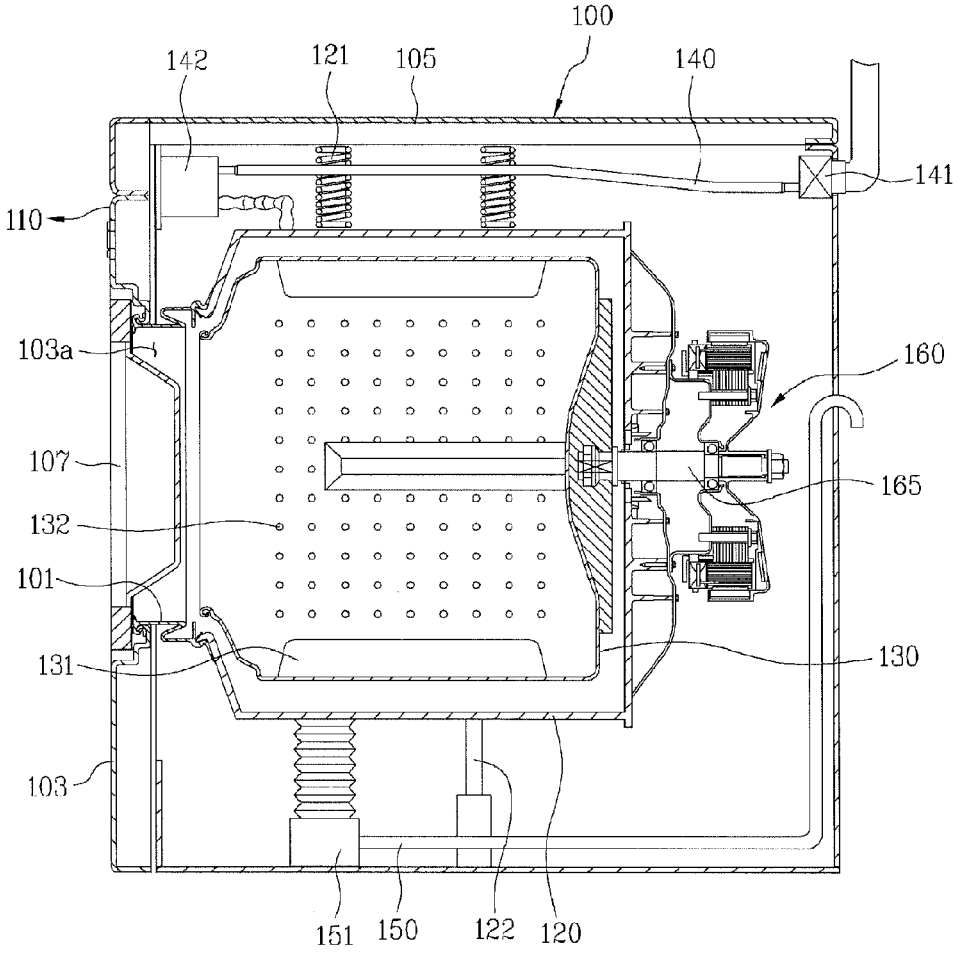
FIG. 2 is a sectional view of the washing machine according to the embodiment of the present invention.
Figure 3:
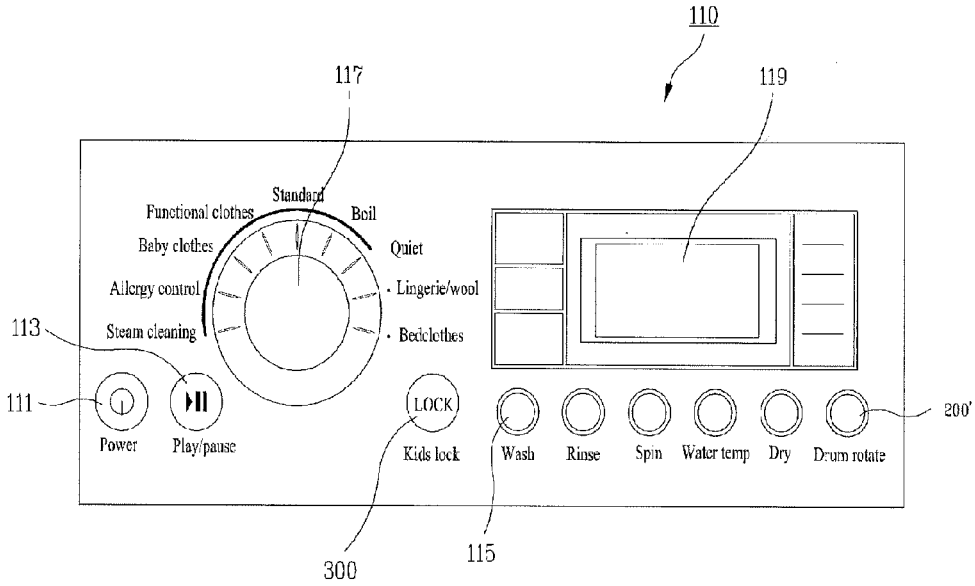
FIG. 3 is an enlarged view illustrating a control panel of the washing machine shown in FIG. 1.
Figure 4:
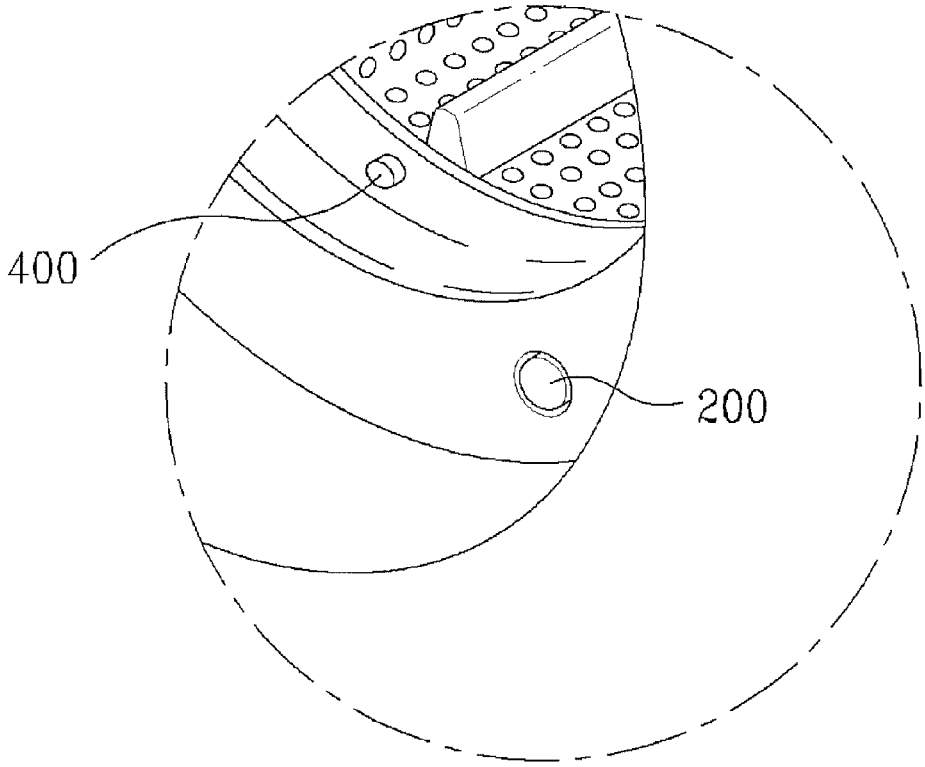
FIG. 4 is an enlarged view of the portion 'A' of FIG. 1, illustrating an independent drive input unit of the washing machine.

In the accompanying drawings, FIG. 1 is a perspective view of a washing machine according to an embodiment of the present invention, FIG. 2 is a sectional view of the washing machine according to the embodiment of the present invention, FIG. 3 is an enlarged view illustrating a control panel of the washing machine shown in FIG. 1, and FIG. 4 is an enlarged view of the portion 'A' of FIG. 1, illustrating an independent drive input unit of the washing machine.

As shown in FIGS. 1 and 2, the drum washing machine according to the embodiment of the present invention broadly includes a cabinet 100 defining an exterior appearance of the washing machine, a tub 120 mounted in the cabinet 100 and configured to receive wash water therein, a drum 130 rotatably mounted in the tub 120, and a motor 160 to drive the drum 130. A control panel 110 is provided at an exterior of the cabinet 100. The control panel 110 serves to display operating conditions of the washing machine and provides a variety of function buttons to allow a user to select various functions.

The cabinet 100 is perforated in a front side thereof with an opening 103*a*, through which laundry can be put into the drum 130. The opening 103*a* is closed or opened by a door 107. A door gasket 101 is installed inside the opening 103*a*, i.e. a gap between the cabinet 100 and the tub 120. The door gasket 101 serves to keep the interior of the washing machine water tight, to prevent leakage of wash water through the opening 103*a*.

The top of the tub 120 is supported by hanging springs 121 provided at the top of the cabinet 100, and the bottom of the tub 120 is supported by a friction damper 122 provided at the bottom of the cabinet 100. With this supporting arrangement, the tub 120 serves to reduce vibration caused in the drum washing machine when the drum 130 is rotated at a high speed.

The drum 130 is provided at an inner peripheral surface thereof with a plurality of lifters 131. The lifters 131 act to lift the laundry put into the drum 130 to a predetermined height. Also, the drum 130 is perforated with a plurality of holes 132, so that wash water escapes the drum 130 during, e.g., a dehydrating operation.

A water supply hose 140 is connected to the top of the tub 120, to guide water from an external water source to the interior of the tub 120. A water supply valve 141 is installed on the water supply hose 140 and serves to control entrance/exit of wash water.

A drain hose 150 and a drain pump 151 are installed below the tub 120 and serve to discharge wash water used in, e.g., washing and rinsing operations.

The motor 160 is mounted to a rear side of the tub 120. The motor 160 is coupled to the drum 130 via a rotating shaft 165 and serves to rotate the drum 130.

As shown in FIG. 3, the control panel 110 includes a display unit 119 to display operating conditions of the washing machine and a variety of functions selected by the user. In addition, the control panel 110 includes function buttons capable of setting operations of the drum washing machine, and a control unit (not shown) to control constituent elements and functions of the washing machine.

The function buttons include a power button 111 to switch on or off a power source, a play/pause button 113 to pause an operation of the washing machine, function selecting buttons 115 capable of setting details of a washing course, and a course selecting button 117 to initiate an automatically set washing course.

The control panel 110 may further be provided with an independent drive input unit 200 and a child lock button 300 to prevent a child from operating the function buttons, which will be described in detail hereinafter.

When the user selects a preset course, such as, e.g., a standard course or wool course, or sets a washing process (here, "washing process" includes a series of washing, rinsing, dehydrating, and drying operations, and is distinguished from the washing operation that is carried out to remove contaminants from the laundry) using the function buttons 115, the washing process is carried out based on the set content.

After the washing process is completed, the user is allowed to pull out the completely washed laundry. In this case, it may often be observed that the laundry tends to one side or clumps together. Large articles of laundry may be easily pulled out because they are easily distinguishable from each other. However, small articles of laundry, such as socks, may become trapped between different kinds of laundries or be placed on the lifters.

Under the above described situation, it is proposed to operate the independent drive input unit 200, so as to rotate the drum 130 to cause the laundry to be separated.

Hereinafter, the independent drive input unit 200 according to the embodiment of the present invention will be described in detail with reference to FIGS. 3 and 4.

The independent drive input unit 200 is used to rotate and drive the drum 130 independently of the washing process. This function of driving the drum 130 independently may be adopted in order to search for small size articles of laundry as described above.

As shown in FIGS. 3 and 4, the independent drive input unit 200 may take the form of a button mounted on the cabinet 100.

Specifically, the independent drive input unit 200 may be provided at a portion of the cabinet 100 that is exposed to the user when the door 107 is opened (see FIG. 4), or may be provided on the control panel 110.

When the independent drive input unit 200 is provided on the control panel 110, there is no risk of any structure unintentionally pressing the independent drive input unit 200. However, when the independent drive input unit 200 is provided at the cabinet 100 at the position adjacent to the door 107, the independent drive input unit 200 may be erroneously operated by the door 107 when the door 107 is closed.

For this reason, it is preferred that the independent drive input unit 200 be positioned so as not to be pressed by the door 107 when the door 107 is closed. For this, a hole may be formed in the cabinet 100, so that the independent drive input unit 200 in the form of a button is inserted into the hole.

Alternatively, the erroneous operation of the independent drive input unit 200 may be prevented in such a manner that the control unit (not shown) does not process a signal received from the independent drive input unit 200 in a closed state of the door 107 even if the independent drive input unit 200 is pressed.

The independent drive input unit 200 functions to automatically operate the drum 130 when the user pulls the laundry out of the drum 130. If the user pushes the independent drive input unit 200, a signal to command rotation of the drum 130 is transmitted to the control unit. The control unit rotates the drum 130 in response to the signal, causing the laundry to be separated.

In this case, if the drum 130 is rotated at a high speed, there is a risk of a user accident. Also, there is a risk that the laundry still clumps together rather than being separated by inertia. Therefore, it is preferred that the drum 130 be rotated at a much lower speed than in the washing process.

For this, if the independent drive input unit 200 transmits an operating signal to the control unit, the control unit controls the drum 1300 so that the drum 130 is rotated at a preset revolutions per minute. The preset revolutions per minute may be preset prior to sale of the washing machine.

For example, the preset revolutions per minute may be set to a low speed value so that the drum 130 is rotated at 0.5 revolutions per second to 1 revolution per second.

When the signal is transmitted from the independent drive input unit 200, in addition to controlling the drum 130 to be rotated at the preset revolutions per minute, the drum 130 may be controlled to be stopped after a single forward rotation thereof.

Alternatively, the drum 130 may be controlled in such a manner that it is rotated at a preset revolutions per minute and also, is stopped after being sequentially rotated forward one revolution and reverse one revolution.

Assuming that the user pushes the independent drive input unit 200 plural times, the drum 130 may be controlled to be stopped after being rotated forward one revolution or to be stopped after being sequentially rotated forward one revolution and reverse one revolution, or may be controlled so that a single forward rotation and a single reverse rotation are alternately repeated based on the number of times the independent drive input unit 200 is pushed.

In addition, the drum 130 may be controlled in such a manner that it is operated only while the signal is transmitted from the independent drive input unit 200. For example, if the user pushes the independent drive input unit 200 for 5 seconds, the drum 130 may be controlled to perform a single forward rotation thereof or to be stopped after being sequentially rotated forward one revolution and reverse one revolution for 5 seconds, or may be controlled to repeatedly perform any one of different rotational patterns including, e.g., a single forward rotation and a single reverse rotation for 5 seconds.

Meanwhile, the independent drive input unit 200 may be set to be operated only after the signal is continuously transmitted for a predetermined time or more, in order to prevent the independent drive input unit 200 from being unintentionally operated by a child, or to prevent any possible user accident.

For example, if the user pushes the independent drive input unit 200 for 3 seconds or more when the user pulls out laundry, the drum 130 may be set to be rotated at a preset revolutions per minute. Preferably, providing the child lock button 300 capable of preventing a child from operating the function buttons may prevent the drum 130 from being unintentionally rotated by a child.

In this case, the child lock button 300 may be provided on the control panel 110. The drum 130 is controlled so as not to be rotated in a key locking state even if the independent drive input unit 200 is pushed for a predetermined time or more, or is pushed plural times.

However, after the child lock button 300 is pushed to release the key locking state, the control unit may apply an operating signal to the drum 130 so as to operate the drum 130 when the signal of the independent drive input unit 200 is transmitted to the control unit.

In the washing machine having the above-described configuration according to the embodiment of the present invention, generally, the user is allowed to pull out laundry at a time after the entire washing process is completed and the power source is switched off.

Accordingly, since power required for operating the independent drive input unit 200 is also cut off, it is necessary to supply power for operation of the independent drive input unit 200 as well as rotation of the drum 130.

For this, the control unit maintains standby power even if the power source of the washing machine is switched off, to supply power required for operation of the independent drive unit 200 and rotation of the drum 1300.

Alternatively, the independent drive input unit 200 may serve as a start button. When the independent drive input unit 200 is pushed to generate a signal, the control unit may apply power to the independent drive input unit 200 in response to the input signal. In this case, although the power may be applied to the entire washing machine, it is preferred that the power be applied only to the independent drive input unit 200 and the drum 130 in consideration of energy efficiency. For this, a separate power supply circuit may be provided to supply power to the independent drive input unit 200 and the drum 300 when the power source of the washing machine is switched off.

Meanwhile, in the case of the washing machine according to the present invention, it is noted that the user may use the washing machine at night although the washing machine is usually used in the daytime.

When the user opens the door 107 to pull out laundry in an off state of the washing machine, the user may have difficulty seeing the interior of the drum 130 because the interior of the drum 130 is dark. Therefore, a lamp 400 to illuminate the interior of the drum 130 may be additionally provided.

The lamp 400 is preferably installed to irradiate light toward the interior of the drum 130. In addition, it is preferred that power be applied to the lamp 400 in the same manner as the independent drive input unit 200 and the drum 130 as described above, so as to illuminate the interior of the drum 130 even in the off state of the washing machine.

MODE FOR THE INVENTION

Various embodiments have been described in the best mode for carrying out the invention.

INDUSTRIAL APPLICABILITY

As is apparent from the above description, in a washing machine having the above described configuration, when a user pulls out laundry after completion of a washing process, the user may rotate a drum by simply operating an independent drive input unit without manually rotating the drum to separate the laundry. This has the effect of enhancing user convenience. Further, even if it is necessary for the user to pull out the laundry in a dark environment, a lamp provides the user with a visual field, allowing the laundry to be pulled out conveniently.

Although the above described embodiment describes the drum type washing machine in which a drum is rotated during a washing process by way of example, of course, the above description is applicable even to a pulsator type washing machine in which a pulsator mounted in a drum is rotated.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A washing machine comprising:

a cabinet defining an exterior appearance of the washing machine;

a tub mounted in the cabinet and configured to receive wash water therein;

a drum rotatably mounted in the tub and configured to receive laundry therein;

an independent drive input unit configured to send a drum rotating signal to thereby allow a user to operate the drum independently of a washing process;

a power source configured to supply power to the drum during the washing process;

a secondary power supply circuit configured to supply power to the independent drive input unit and the drum based on the power source being switched off; and a control unit configured to control rotation of the drum in response to the signal received from the independent drive input unit.

2. The washing machine according to claim 1, wherein the cabinet includes a control panel on which a plurality of function buttons is installed, and a door for input of the laundry.

3. The washing machine according to claim 2, wherein the independent drive input unit is provided on the cabinet.

4. The washing machine according to claim 3, wherein the independent drive input unit is provided at a portion of the cabinet which is exposed to the user when the door is opened.

5. The washing machine according to claim 4, wherein the independent drive input unit is positioned so as not to be pressed by the door when the door is closed.

6. The washing machine according to claim 2, wherein the control panel further includes a child lock button to prevent operation of washing machine by a child.

7. The washing machine according to claim 6, wherein the independent drive input unit applies an operating signal after a locking state is released by operation of the child lock button.

8. The washing machine according to claim 2, wherein the independent drive input unit is provided on the control panel.

9. The washing machine according to claim 1, wherein the drum is controlled to be rotated at preset revolutions per minute when the signal is received from the independent drive input unit.

10. The washing machine according to claim 9, wherein the drum is controlled to perform a single forward rotation when the signal is received from the independent drive input unit.

11. The washing machine according to claim 9, wherein the drum is controlled to sequentially perform a single forward rotation and a single reverse rotation when the signal is received from the independent drive input unit.

12. The washing machine according to claim 9, wherein the drum is controlled to be operated after the signal is continuously received from the independent drive input unit for a predetermined time or more.

13. The washing machine according to claim 9, wherein the drum is controlled to be operated only while the signal is being received from the independent drive input unit.

14. The washing machine according to claim 9, wherein the control unit maintains standby power even if the power source is switched off, to operate the drum when the signal is received from the independent drive input unit.

15. The washing machine according to claim 9, wherein the control unit applies power even if the power source is switched off, to operate the drum when the signal is received from the independent drive input unit.

16. The washing machine according to claim 1, wherein a door gasket for water tightness is installed between the door and the tub, and a lamp is installed on the door gasket to irradiate light toward the interior of the drum.

17. The washing machine according to claim 1, wherein the secondary power supply circuit is separate from the power source.

18. The washing machine according to claim 1, wherein the secondary power supply circuit is configured to supply power to the independent drive input unit and the drum without supplying power to other elements of the washing machine.

* * * * *